United States Patent [19]

Shuman

[11] 4,399,574

[45] Aug. 23, 1983

[54] NOVEL MATTRESS PAD

[76] Inventor: Joseph G. Shuman, 20 Highlander Dr., Scotch Plains, N.J. 07076

[21] Appl. No.: 222,921

[22] Filed: Jan. 6, 1981

[51] Int. Cl.[3] ..... A47C 21/00; A47C 27/00

[52] U.S. Cl. ..... 5/417; 5/431

[58] Field of Search ..... 5/417–420, 5/482, 431, 448

[56] References Cited

U.S. PATENT DOCUMENTS

| | | | |
|---|---|---|---|
| 1,019,212 | 3/1912 | Yates | 5/417 |
| 1,904,039 | 4/1933 | Bruder | 5/417 |
| 2,948,334 | 8/1960 | Goldstein | 5/468 |
| 3,681,797 | 8/1972 | Messner | 5/469 |

FOREIGN PATENT DOCUMENTS

| | | | |
|---|---|---|---|
| 929002 | 1/1956 | Fed. Rep. of Germany | 5/420 |

*Primary Examiner*—Alexander Grosz

*Attorney, Agent, or Firm*—Bucknam and Archer

[57] ABSTRACT

A pad for use on top of conventional mattresses, cushions and the like is described which comprises a plurality of ribs, separated by troughs, the pad being made of an elastomeric material having a Shore A hardness between 75 and 95, the overall size of the pad being adequate to provide back support for the user when the pad is arranged with the ribs in a direction perpendicular to the spinal cord of the user and also providing flexibility in the longitudinal direction conforming readily to the natural curve of the spine, but very supportive in the direction perpendicular to the spine owing to the relative rigidity of its cross-sectional structural configuration. The pad may have a corrugated structure or the ribs may be provided by a plurality of structures arranged in series which may be hollow or solid, square or rectangular. The structures may also have an inverted L-shape or a T-shape.

1 Claim, 6 Drawing Figures

NOVEL MATTRESS PAD

Figure 1:
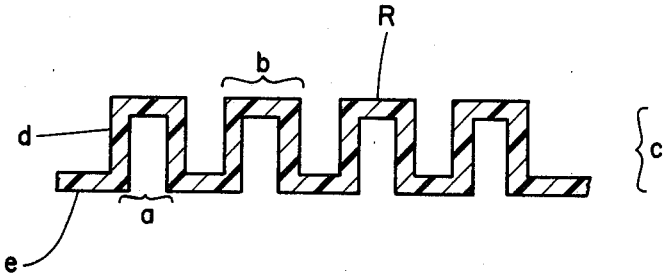

The present invention relates to a pad for mattresses and the like such as cushions, pillows, chairs, sofas, and hammocks. More specifically, the present invention relates to a pad to be used by people who suffer from backache, but it may be used advantageously by anyone, no matter whether the individual suffers from backache or not.

In the last twenty years, it is well-known that mattresses and cushions have been made with a soft synthetic resin for the filling, usually a foamed resin. With this soft filling, the body of the user has a tendency to sink into the mattress and the back, as well as the hips of the body, are left without support. This condition becomes more and more aggravated with wear of the mattress and particularly people who have backache find it extremely inconvenient. It is well-known that many people affected by backache, out of restlessness, prefer to sleep on the floor so that atleast they have a hard surface under their back.

Many proposals have been made to eliminate this drawback. One such proposal is described in U.S. Pat. No. 3,974,532. This patent describes a padding which consists of a plurality of flexible elongated padding members disposed in the direction parallel to a soft board base. Essentially, the flexible elongated members are arranged in the direction perpendicular to the spinal cord of the user when the individual sleeps in a conventional manner in a bed with the head against the headboard and the feet at the opposite end, so that the individual cannot sink into the mattress. According to this patent, the elongated members are made of relatively hard flexible material, preferably foamed resin. According to this patent, foamed polyethylene or a foamed resin made by mixing polyvinyl butyral with polyethylene or polypropylene could be used. The patent also mentions the use of a synthetic rubber and foamed butadiene. The elongated members are preferably semi-cylindrical in their cross-section, but could be oval, semi-circular or any other shape. According to one embodiment of this patent, the elongated members may be provided with small projections on the outer surface. The purpose of the projections is to promote circulation of blood by stimulation of the human body during sleep. Although it is possible that the mattress of this patent gives adequate support, conformation to the spine is not provided. Further, it is manifest that the reference does not provide the solution to the problem in an economical and practical manner, because the mattress would require a totally special construction and would be very expensive.

The mattress described in U.S. Pat. No. 4,161,045, is also intended to support the body of the user in areas of greatest weight, shoulders, buttocks, etc., to prevent the body from sinking into the mattress. Also, this mattress is very expensive to manufacture and not suitable for commercial production because it requires several sets of support ribs of relatively low compressibility which extend transversely of the mattress and which are spaced longitudinally apart from one another at points corresponding to the areas of greatest body weight, because they are placed at points where localized support is needed. The ribs may extend across the entire mattress. The low compressibility of the ribs serves the purpose of decreasing the overall compressibility of the mattress. The patent also states that ribs could be disposed vertically in addition to being arranged horizontally.

In view of the fact that the ribs are separated one from the others, each rib is capable of being compressed independently from the others so that they may be placed in positions where the greatest resistance to compression is required. The patent describes a method of manufacture of the mattress which consists of joining two layers of resilient material and disposing between the two layers at least two sets of the ribs, the material of the ribs being less compressible than the material used for the mattress. Clearly, also the mattress of this reference is expensive to manufacture and would have to be made to order for each user, placing the sets of ribs in the location where support is required and this obviously varies according to the height and the particular condition of each individual.

An object of the present invention is to provide a pad which provides support for people who are affected by backache and who need support during sleep, but may be advantageously used by anyone even in the absence of backache.

Another object of the present invention is to provide a mattress pad which may be manufactured inexpensively and which is suitable for commercial production.

Still another object of the present invention is to provide a mattress pad which may be manufactured in a few standard sizes so that the high cost of manufacture to order is avoided.

Still another object of the present invention is to provide a mattress pad which may be easily removed, rolled up and transported from one location to the other so that an individual travelling may take it along with him to use in any hotel room and wherever he may happen to be.

The crux of the present invention resides in the finding that by selecting a material exhibiting a hardness in a certain specified range, as it will be described more specifically hereinbelow, a pad is obtained which is rigid enough to provide support for the user and at the same time is not too rigid to be uncomfortable. According to a preferred embodiment of the invention, the flexibility modulus as tested by ASTM-D-790 is 25,000–45,000 p.s.i. An essential feature of the pad according to the present invention, is that it may be placed on top of the mattress, merely under the conventional mattress cover and does not require the production of a special mattress so that the user may continue to use ordinary mattresses.

Figure 4:
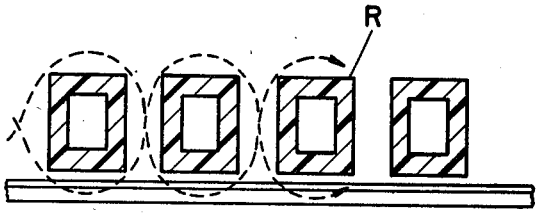
Figure 5:
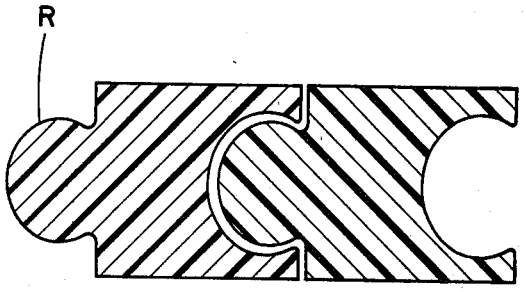
Figure 6:
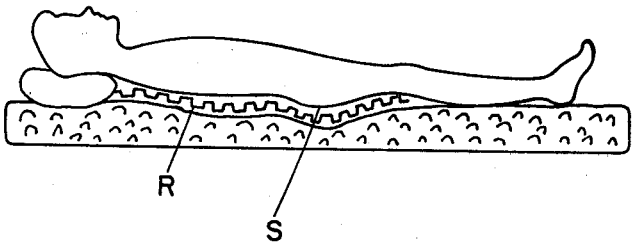

The invention is illustrated by reference to the drawings which:

FIGS. 1–5 show different embodiments of the mattress pad according to the present invention and FIG. 6 shows the pad of the invention disposed between the conventional sheet and a conventional mattress.

Figure 2:
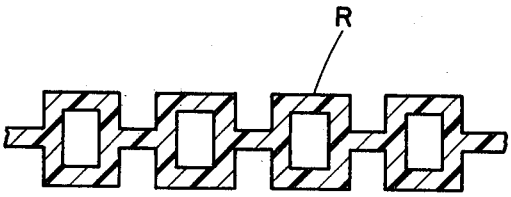
Figure 3:
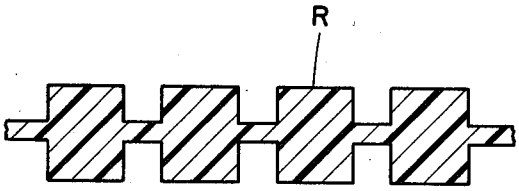

Specifically, in the embodiment of FIG. 1 the pad has a corrugated configuration. In FIG. 2, the pad comprises a plurality of hollow tubes which may be square or rectangular. In FIG. 3, the same configuration is shown but the pad comprises a plurality of solid square or rectangular structures. The embodiment of FIG. 4 is a laminate with a plurality of hollow tubes, which may be square or rectangular, bonded to a substrate by means of an adhesive. Instead of using an adhesive, the individual hollow structures could be attached to one another by means of nylon cords. The dotted lines designate the nylon cords to hold together the hollow structures which may be woven and in this case no substrate base or adhesive is required. In FIG. 5, molded strips with an almost circular convex surface on one side and a concave surface opposite to it, are arranged with the convex circular surface of one strip fitting into the concave surface of the adjacent strip. Although not illustrated in the drawings, different configurations could be used still providing a plurality of ribs separated by a plurality of troughs. For instance, a plurality of T-shaped structures arranged in series or a plurality of inverted L-shaped structure could be used.

As illustrated in FIG. 1, the present invention comprises a pad which is corrugated, made of a material exhibiting a Shore A hardness between 75 and 95. Preferably, the length of a trough represented by the symbol a in FIG. 1 is between $\frac{1}{8}$ and $\frac{1}{2}$ inch. The length of the peak b is between $\frac{1}{4}$ of an inch up to $1\frac{1}{2}$ inch. The overall height of the pad c from the top of the peak to the bottom of the trough is between $\frac{1}{4}$ inch up to 1 inch. The thickness of the material d and e used to make the pad is between 1/32 of an inch up to $\frac{1}{8}$ of an inch, but the thickness d and e are not necessarily the same throughout because if the length b is made greater than length a, then the thickness d could be as much as $\frac{5}{8}$ inch and the thickness e could be as low as 1/32 inch.

Although in FIG. 1 the corners are essentially at right angles, the corners are preferably rounded.

The overall dimensions a, b and c defined hereinabove in reference to FIG. 1, are essentially the same in the embodiments of FIGS. 2–5, for instance, the overall height of the structures is also as c in FIG. 1. Although, different embodiments are shown, it is clear that they all provide a plurality of ribs, R, arranged in the direction perpendicular to the spinal cord of the user.

FIG. 6 shows the pad of the invention disposed between the conventional sheets and the mattress and shows that the pad conforms to the contour of the spinal cord of the user while the structure also supports the back of the user.

The invention is not limited to any particular thermoplastic or thermosetting resin and a number of known elastomeric materials may be used provided the Shore hardness is within the range defined hereinabove. Thus, by way of example, the material may be a thermoplastic resin which may be a polymer resin compound such as ethylene-propylenediene monomer with added propylene or there may be used a block copolymer of butadiene-ethylene styrene or a cross-linked polyurethane. An ethylene-ethyl acrylate copolymer or ethylene-vinyl acetate copolymer or a polyolefin may also be used provided the hardness is within the range defined hereinabove.

Among the thermosetting resins within the scope of the present invention, it is possible to use the copolymer of styrene and butadiene or natural rubber or an elastomeric polyester, polychloroprene, butadiene-acrylonitrile rubber, or butyl rubber.

In actual use, the pad according to the present invention provides great flexibility because the flexibility modulus as tested by ASTM-D-790 is 25,000–45,000 p.s.i. in the longitudinal direction, that is in the direction of the spinal cord of the user, because it is placed on top of the mattress with the ribs R in the direction perpendicular to the spinal cord of the user. However, in view of the low compressibility of the material and the cross-sectional configuration of the finished unit, the pad provides support for the back in the direction perpendicular to the spinal column of the user. The nature of the material used and the pad's flexibility in the longitudinal direction permits its use with comfort directly on top of the mattress under the bed sheet and/or the conventional mattress pad close to the body. Referring to the supportive direction, a degree of wraparound conformation is provided since from shoulder to shoulder, of course, the back is not straight. Still another advantage of the pad according to the present invention, is that when the bed is made, it appears as a conventional bed. It is also clear from the foregoing disclosure that the mattress may be provided in a few standard sizes to fit a small child, as well as an individual six feet tall or even taller. In view of the fact that most of the support required is in the middle of the mattress, the pad may be made of an overall width slightly less than the width of the mattress in accordance with standard mattress sizes, that is a twin, full, queen, or king size bed. It is also clear from the foregoing, that the pad according to the present invention may be made in a smaller size to fit the back of a car seat, or a cushion of a sofa of the conventional hammocks for outdoor use. The pad according to the present invention in view of the troughs between the peaks, provides sufficient aeration.

The pad according to the present invention may be manufactured by conventional methods such as extrusion molding or thermoforming. According to a preferred embodiment of the invention, a strip may be placed at the edge of the pad in the longitudinal direction to provide a moderate amount of stretching.

What is claimed is:

1. A pad for mattresses, cushions and the like which consists of a plurality of ribs, separated by troughs, said pad being made of an elastomeric material having a Shore A hardness between 75 and 95, the overall size of the pad being adequate to provide back support for the user when the pad is arranged with the ribs in a direction perpendicular to the spinal cord of the user and also providing flexibility in the longitudinal direction, said pad being a flat flute corrugated structure, the peaks of the corrugations forming the ribs, the flexibility modulus of said elastomeric material as tested by ASTM-D-790 being 25,000–45,000 p.s.i., the distance between two adjacent ribs being between $\frac{1}{8}$ and $\frac{1}{2}$ inches, and the length between the top of a rib and the bottom of a through being between $\frac{1}{4}$ and one inch.

* * * * *